United States Patent [19]

Rhodes

[11] Patent Number: 4,644,869

[45] Date of Patent: Feb. 24, 1987

[54] DEVICE FOR INTERRUPTING THE MOVEMENT OF LOAD CARRYING UNITS ALONG A CONVEYOR PATH

[76] Inventor: Arthur B. Rhodes, 7227 Helen Ave., Louisville, Ky. 40258

[21] Appl. No.: 632,581

[22] Filed: Jul. 19, 1984

[51] Int. Cl.[4] ..... B61K 7/02; B61B 10/04

[52] U.S. Cl. ..... 104/172.2; 104/252

[58] Field of Search ..... 104/172 R, 172 BT, 205, 104/211, 238, 239, 249, 252, 253, 173 R, 204, 205, 250, 251, 299; 198/345, 472, 465.1

[56] References Cited

U.S. PATENT DOCUMENTS

| | | | |
|---|---|---|---|
| 1,396,127 | 11/1921 | Kuretich | 104/253 |
| 2,416,473 | 2/1947 | Fields | 104/253 |
| 3,092,038 | 6/1963 | Orwin | 104/250 |
| 3,158,105 | 11/1964 | Robbins et al. | 104/172 BT |
| 3,315,614 | 4/1967 | Braun, Jr. | 104/172 BT |
| 3,742,860 | 7/1973 | Fahringer | 104/172 BT X |
| 3,894,629 | 7/1975 | Wakabayashi | 104/172 BT X |
| 3,995,561 | 12/1976 | Allor, Jr. | 104/172 S |
| 4,287,829 | 9/1981 | Wakabayashi | 104/172 S |

FOREIGN PATENT DOCUMENTS

| | | | |
|---|---|---|---|
| 462595 | 7/1928 | Fed. Rep. of Germany | 104/253 |

*Primary Examiner*—Robert B. Reeves
*Assistant Examiner*—David F. Hubbuch
*Attorney, Agent, or Firm*—Charles G. Lamb

[57] ABSTRACT

A device for interrupting the movement of load carrying units, such as carts or pallets, moving with a conveyor system. The device includes a movable conveyor engagement mechanism associated with each of the carts which is movable between a conveyor system engagement position and disengagement position by a movable actuator disposed at a first preselected location along the conveyor path at which the movement of a cart is to be interrupted. The movable actuator is controlled by a trigger mechanism disposed at a second predetermined location upstream of the movable actuator. The trigger mechanism is activated in response to a following cart moving with the conveyor past the trigger mechanism.

15 Claims, 10 Drawing Figures

DEVICE FOR INTERRUPTING THE MOVEMENT OF LOAD CARRYING UNITS ALONG A CONVEYOR PATH

BACKGROUND OF THE INVENTION

1. Field of the Invention

This invention relates to conveyor systems for moving load bearing units, such as carts and pallets, along a path defined by the conveyor system. More particularly, the invention is directed to a device for interrupting the movement of load bearing units at preselected locations along the conveyor path.

2. Description of the Prior Art

Various stop mechanisms for use with conveyor systems are known. Examples of these known mechanisms are discussed in the following United States Patents.

U.S. Pat. No. 3,158,105 teaches a conveyor system having a stop mechanism for automatically disconnecting a rack or trolley from a conveyor chain. The trolley has a towing arm which is pivotally mounted at one of its ends to the trolley and has a latch plate at its other end. The stop mechanism includes an arm pivotally mounted to a floor plate at a pivot point for horizontal swinging movement about the pivot point toward and away from the conveyor chain. When the arm is in a position away from the chain the stop mechanism is in a trolley pass position, and when the arm is in a position toward the chain the stop mechanism is in a trolley stop position. The arm is moved toward the stop position by a solenoid and is moved toward the pass position by a spring. The solenoid is actuated by a person as the trolley moves into position at the stop mechanism.

U.S. Pat. No. 3,315,614 teaches a conveyor system wherein a series of carts are moved by a conveyor chain. The conveyor chain includes a plurality of spaced apart dogs. Each cart has a vertically movable tow pin at its front end. When the tow pin is in the lowered position it engages the dogs of the conveyor chains so that the cart moves with the conveyor chain. When the tow pin is in the raised position it is disengaged from the dogs so that the cart will not move with the conveyor chain. The tow pin has a crossbar attached thereto which contacts a cam mounted on the floor next to the conveyor chain to lift the tow pin out of engagement with the conveyor chain dogs. Each cart also has a cam affixed thereto projecting to the rear of the cart. As a following cart moves against a stopped cart, the rearwardly projecting cam of the stopped cart contacts the crossbar of the following cart raising the tow pin of the following cart out of engagement with the conveyor chain dogs, thus, also stopping the following cart.

U.S. Pat. No. 3,894,629 teaches a conveyor system having a first chain conveyor and a second chain conveyor transversely located relative to the first chain conveyor. The first chain conveyor has a plurality of pivotally mounted pallet pusher members located therealong for engaging downwardly projecting flanges of pallets for moving the pallets with the chain conveyor. A stop device is located at a predetermined location along the chain conveyor. The stop device includes a movable cam and arresting dogs actuated by a hydraulic cylinder. The hydraulic cylinder is activated to move the cam and arresting dogs between a pallet stop position and a pallet release position. When the stop device is in the pallet stop position, the cam contacts the pivotal pallet pusher member pivoting the pusher member out of engagement with the flanges of the pallets which move the arresting dogs into engagement with the flange of the pallet, thus, stopping the pallet. When the stop device is in the pallet release position, the cam allows the pallet pusher member to pivot into engagement with the flange of the pallet while moving the arresting dogs out of contact with the flange of the pallet, thus, causing the pallet to move with the conveyor chain.

U.S. Pat. No. 3,995,561 teaches a power-and-free conveyor system having a main conveyor track and an adjacent power conveyor chain. A plurality of carriers are mounted on the track. Each carrier has a pivotally mounted pusher dog. The power conveyor chain includes a plurality of projecting pusher dogs. When the pusher dog of a carrier is pivoted to an elevated position, a pusher dog on the power conveyor chain engages the pusher dog causing the carrier to move along the conveyor track as the power conveyor chain moves. When the pusher dog of a carrier is pivoted to a recessed position, the pusher dog will not engage the pusher dog, and, therefore, the carrier will not be moved by the power conveyor chain. The pusher dog of each carrier has a forwardly projecting arm, the movement of this arm causing the pusher dog to pivot between the elevated and recessed positions discussed above. In operation, when the projecting end of the actuating arm of a following carrier contacts the rear of a preceding stopped carrier, the pusher dog of the following carrier is caused to pivot to the recessed position disengaging from the pusher dog of the power chain conveyor, thus, causing the following carrier to also stop.

U.S. Pat. No. 4,287,829 teaches a power-and-free conveyor system having a power chain location above a rail. Carriers have wheels which ride on the rail. The front wheels are covered by fenders and the rear wheels are covered by fenders. A plurality of pusher dog support members are attached at spaced intervals to the power chain for movement therewith. Each pusher dog support member has a pivotally mounted pusher dog and a pivotally mounted cam mounted in front of and connected to the pusher dog through a link arrangement. When the pusher dog is in the lowered position it contacts the back side of the fender over the front wheels of the carrier, thus, moving the carrier with the power chain. When the pusher dog is in the raised position, it is out of contact with the front fender and the carrier is disengaged from the power chain. A stop device is located at a predetermined location along the power chain. The stop device includes a pivotally mounted lever which is caused to pivot into and out of engagement with the front fender of a carrier, by a hydraulic position. When the lever contacts the front fender of a carrier, the pivotally mounted pusher dog rides over the front fender of the carrier and the carrier is stopped. When a following carrier makes contact with the stopped carrier, the cam of the following carrier contacts the rear fender of the stopped carrier and pivots the pusher dog of the following carrier out of contact with the front fender of the following carrier causing the following carrier to also stop.

The aforementioned stop mechanisms are relatively complicated in construction and, therefore, difficult to manufacture and maintain in operation.

SUMMARY OF THE INVENTION

The present invention provides, in a conveyor system for moving load bearing units along a path defined by the conveyor system, a device for interrupting the movement of the load bearing units comprising movable conveyor engagement means associated with each of the load bearing units, the movable engagement means being movable between a conveyor engagement position wherein the load bearing units are connected to the conveyor system for movement along the defined path and a conveyor disengagement position, actuating means for actuating the conveyor engagement means of a load bearing unit between the conveyor disengagement position and the conveyor engagement position, and trigger means for triggering the actuating means from the conveyor disengagement position to the conveyor engagement position in response to the preselected location of another one of the load carrying units moving along the conveyor path.

BRIEF DESCRIPTION OF THE DRAWINGS

A better understanding of the present invention will be gained upon reading the following description in conjunction with the accompanying drawings in which like parts are identified by like numerals and wherein.

DETAILED DESCRIPTION

Figure 1:
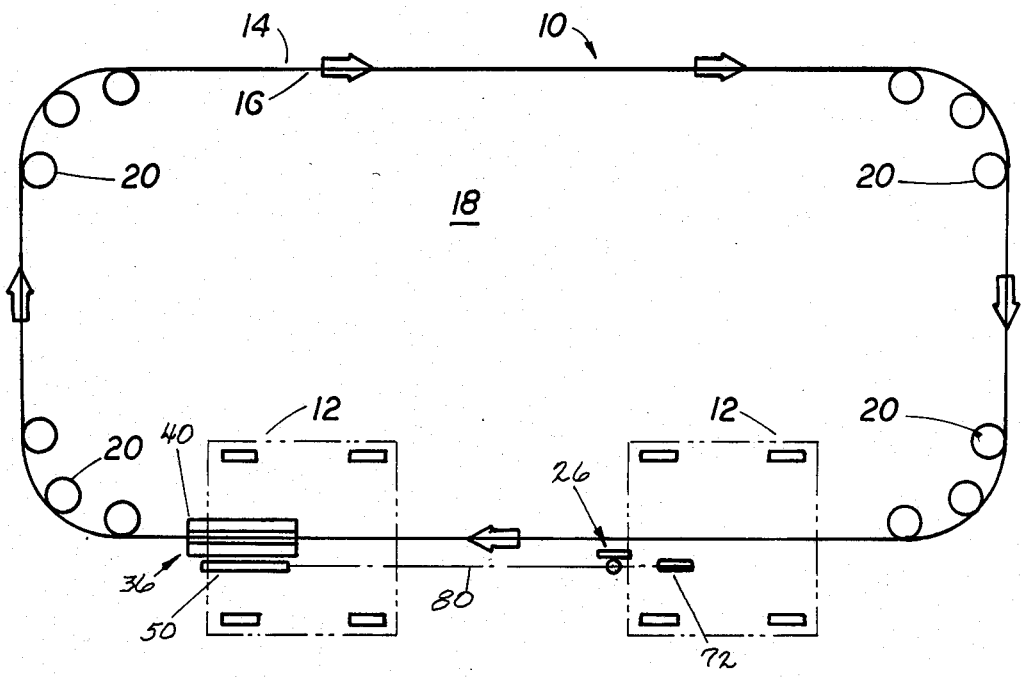
FIG. 1 is a schematic representation of a conveyor system embodying the interruption device of the present invention.

FIG. 1 is a schematic plan view of a conveyor system, generally denoted by the numeral 10, for moving load bearing units 12 (shown in phantom lines), such as carts or pallets, along a path defined by the conveyor system. Such conveyor systems are generally known, and have particular application in, for example, manufacturing for moving work pieces through various work stations.

The conveyor system 10 comprises an endless conveyor chain 14 having a generally horizontal run or flight 16 which moves along the floor 18 of a facility defining the path through which the carts will move. In some installations, the conveyor chain flight 16 will move in a trench formed in the facility floor 18 and in other installations the conveyor chain flight 16 will be located at or just above the facility floor 18. As shown in the FIGS. 1–3, the conveyor chain flight 16 is located just above the facility floor 18 and is at least partially trained around guide sprockets 20 at appropriate locations along the conveyor flight 16 as may be required to define a desired conveyor path along which the carts 12 will be moved. Various methods for powering or moving conveyors are known, and for this reason, and for the additional reason that the means by which the conveyor chain 14 is moved does not form a part of the present invention, the conveyor moving means will not be discussed.

Figure 2:
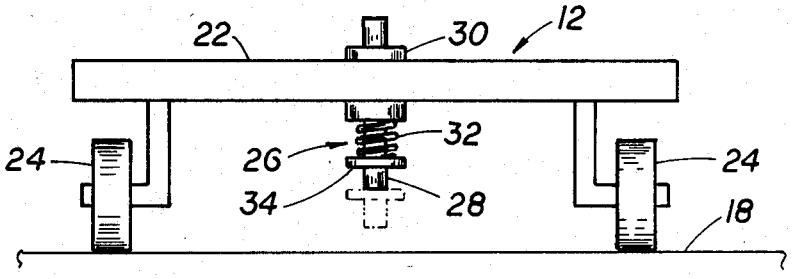
FIG. 2 is a front view of a load bearing unit used with the conveyor system.
Figure 5:
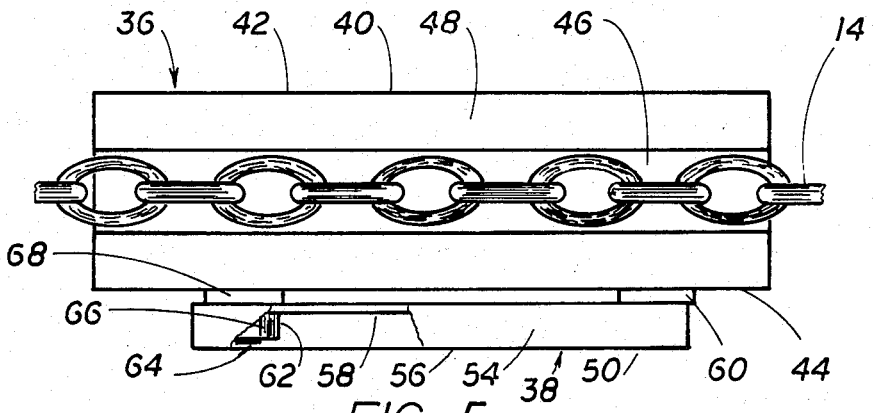
FIG. 5 is a top view of a component of the interruption device of the present invention.
Figure 3:
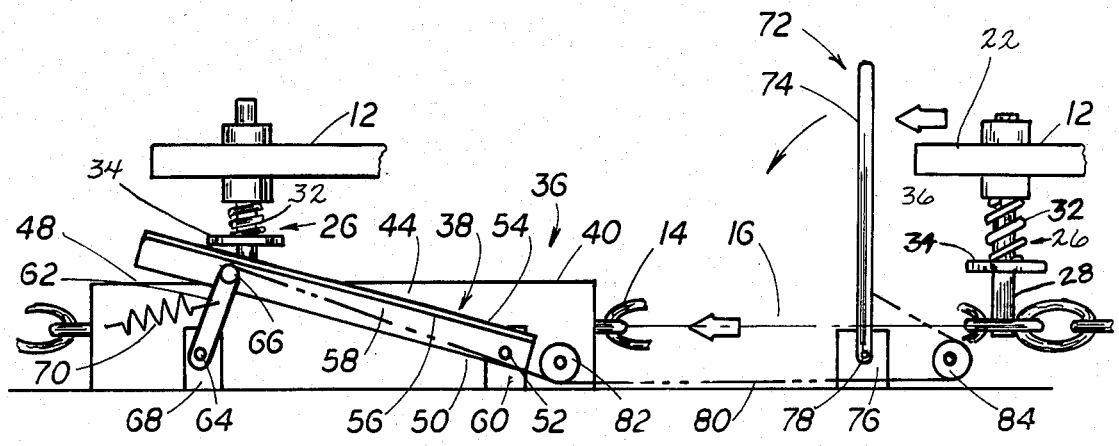
FIG. 3 is an enlarged side view of the interruption device of the present invention in a first position.

With reference to FIGS. 1, 2 and 3, each of the load bearing units or carts 12 to be moved along the path defined by the conveyor flight 16 of the conveyor chain 14 comprises a frame structure 22 for supporting a load such as a work piece (not shown), and floor engaging wheels 24 rotatably attached to the frame structure 22. The frame structure 22 can be of virtually any construction and configuration to support the work piece to be carried thereon. Each loading bearing unit 12 includes movable conveyor engagement means, generally denoted a the numeral 26, which is movable between a conveyor engagement position (shown in phantom lines in FIG. 2) wherein the load bearing unit 12 is connected to the conveyor chain 14 for movement along the defined path, and a conveyor disengaged position (shown in solid lines in FIG. 2). The movable conveyor engagement means 26 is shown as comprising a depending movable pin 28 attached to the cart frame 22. As shown, the movable pin 28 is attached to the front of the frame 22. The movable pin 28 is vertically movable between the lowered conveyor chain engagement position and the raised chain disengagement position. Various constructions can be used to movably attach the pin 28 to the cart frame 22. As illustrated in FIG. 2, the movable pin 28 is axially, slidably received in a cylindrical collar 30, which collar 30 is attached to the cart frame 22 with the longitudinal axis of its bore being vertically disposed. The movable pin 28 is biased toward the lowered chain engagement position by means of, for example, a coil spring 32 which is concentrically disposed over the pin 28. The coil spring 32 is captured between the bottom edge of the collar 30 and a spring keeper 34 attached to the pin 28 near its depending end and extending radially outward from the pin 28. The spring keeper 34 serves an additional function as a cam-like follower, as will hereinafer be discussed. In operation, with the pin 28 biased by the coil spring 32 to the lowered chain engaging position, the depending end of the pin 28 engages the links of the conveyor chain 14. Thus, as the conveyor flight 16 of the conveyor chain 14 moves linearly the cart 12 moves with the conveyor flight along the defined path. When the movable pin 28 is moved to the raised chain disengagement position, against the biasing force of the coil spring 32, the depending end of the pin 28 disengages from the links of the conveyor chain 14 so that the cart 12 will not travel with the chain flight 16.

Figure 4:
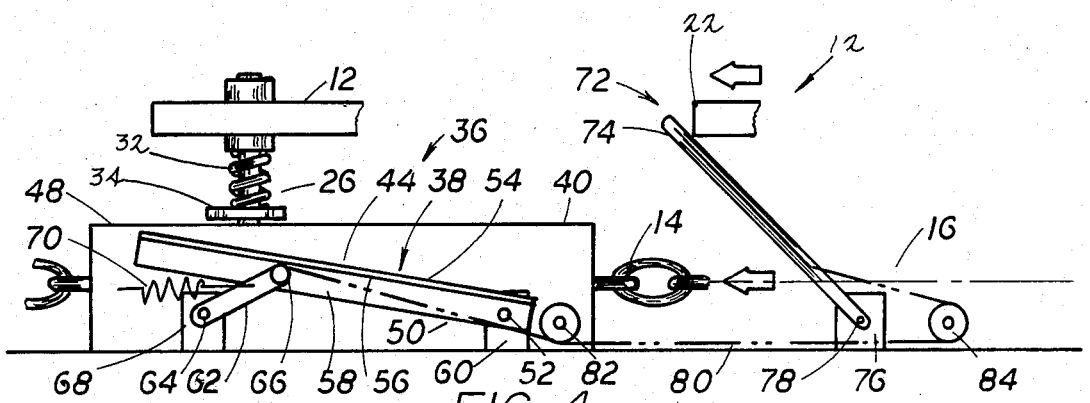
FIG. 4 is an enlarged side view of the interruption device of FIG. 3 in a second position.
Figure 6:
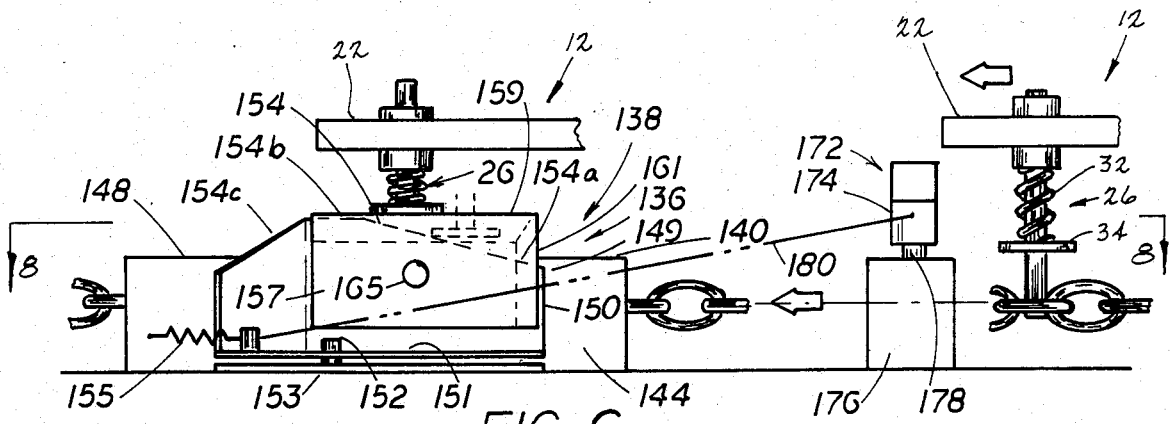
FIG. 6 is an enlarged side view of another advantageous embodiment of the interruption device of the present invention in a first position.

With reference to FIGS. 1, 3 and 4, there is shown a device, generally denoted by the numeral 36, for selectively interrupting the movement of one of the load bearing units 12 at a first predetermined location along the conveyor path defined by the conveyor flight 16. The first predetermined location at which the load carrying unit 12 is stopped could be, for example, a work station at which a particular operation is to be performed on a workpiece carried on the load carrying unit 12, or a loading/unloading station at which a workpiece is loaded or unloaded from the load carrying unit 12. The interruption device 36 includes actuating means, generally denoted by the numeral 38, for actuating the conveyor engagement means 26 of a load bearing unit 12 between the conveyor disengagement position and the conveyor engagement position. As shown, the actuating means 38 includes an elongated open ended housing 40 having spaced apart side walls 42 and 44, and an elongated slot 46 formed in its top wall between the top ends of the side walls 42 and 44, extending from one open housing end to the other open housing end. The housing 40 longitudinally receives the horizontal flight 16 of the conveyor chain 14 through its opposite open ends with the portion of the horizontal flight 16 extending therethrough in parallel alignment with and below the slot 46 of the housing. A vertically disposed activating ramp plate 50 is pivotably mounted to one housing wall, for example side wall 44 of the housing 40 by means of a pivot pin 52. The ramp plate 50 includes an inclined ramp surface 54 extending upwardly in the direction of movement of the conveyor flight 16. The ramp surface 54 is of an appropriate length such that when the ramp plate 50 is pivoted to a first position, the ramp surface 54 projects above the top wall 48 of the housing 40 (see FIG. 3) and when it is pivoted to a second position the ramp surface 54 lays entirely below the top ends of the housing side walls 42 and 44 (see FIG. 4). The ramp device 50 is shown as including a horizontal top plate 56, the top surface of which defines the ramp surface 54, and a depending flange 58. The pivot pin 52 extends through an appropriate hole in the depending flange 58 into a journal block 60 located at the housing side wall 44. In transverse cross-section, the ramp device 50 could be, for example, generally T-shaped or an inverted L-shape. A ramp control arm 62 is pivotally mounted to the housing side wall 44 proximate the free end of the ramp device 50 by means of a pivot pin 64. A ramp contact pin 66 is located at the free end of the ramp control arm 62 and seats in the shoulder formed by the top surface plate 56 and depending flange 58 of the ramp device 52 in contact with the bottom surface of the ramp top plate 56 for sliding movement longitudinally of the ramp top plate 56. The ramp control arm 62 is of an appropriate length such that when it is pivoted to a first position it projects above the top wall 48 of the housing 40 (see FIG. 3) and when it is pivoted to a second position it lays entirely below the top wall 48 of the housing 40 (see FIG. 4). The ramp pivot pin 64 is journalled in a journal block 68 located at the housing side wall 44. The ramp control arm 62 is biased toward the first position extending above the housing top wall 48 by biasing means 70 illustrated as a compression coil spring connected at one of its ends to the housing side wall 44 and at its other end to the ramp control arm 62.

With continued reference to FIGS. 1, 3 and 4, the interruption device 36 further includes trigger means, generally denoted as the numeral 72 for triggering the actuating means 38 from the first or conveyor disengagement position (see FIG. 3) to the second or conveyor engagement position (see FIG. 4) in response to the locating of another moving load bearing unit 12 at a preselected second location well upstream, relative to the direction of movement of the conveyor flight 16, of the preselected first location whereat movement of a load bearing unit 12 has been interrupted by the activating means 38. As shown, the trigger means 72 includes a pivotably mounted lever 74 located next to the conveyor flight 16. The lever 74 is of an appropriate length such that when it is in a first position corresponding to the first or conveyor disengagement position of the actuating means 38, it projects upwardly into the path of a load bearing unit 12 moving with the conveyor flight 16. The lever 74 is pivotably mounted to a journal block 76 by means of a pivot pin 78 extending from the journal block 76 through an appropriate hole at one end of the lever 74.

The trigger means 72 is operatively connected to the activating means 38 by, for example, a cable 80 which is attached at one of its ends to the trigger lever 74 and at its other end to the ramp control arm 62. The cable end attached to the lever 74 is attached thereto at a location between the lever pivot 78 and free end of the lever 74. The cable end attached to the ramp control arm 62 is attached thereto at a location between the pivot 64 and free end of the control arm 62. The cable 80 extends from the ramp control arm 62 at a downward incline generally parallel to the incline of the ramp surface 54, when in the first position, and is partially trained about a first pulley 82 rotatably mounted to the housing side wall 44 near the pivot pin 52 of the ramp plate 50. The cable 80 extends generally parallel to the conveyor flight 16 from the first pulley 82 to a second pulley 84 located upstream, relative to the direction of movement of the conveyor flight 16, of the trigger lever 74. The cable 80 is trained about the second pulley 84 so as to reverse direction and extends from the second pulley 84 in a downstream direction, relative to the direction of movement of the conveyor flight 16, to its attachment at the lever 74. The cable 80 is taut when the lever 74 and ramp plate 50 are in the first or conveyor disengagement position.

In operation, referring to FIG. 3, when a load bearing unit 12 moving with the conveyor flight 16 approaches the actuating means 38 of the movement interruption device 36 which is in the first or conveyor disengagement position, the coil spring keeper 34 of the depending conveyor engagement pin 28 contacts the upwardly inclined ramp surface 54 of the ramp plate 50. The inclined ramp surface 54, thus, forces the conveyor engagement pin 28 to move in its collar 30 upwardly against the biasing force of the coil spring as the load bearing unit 12 continues to move with the conveyor flight 16 until the depending end of the conveyor engagement pin 28 is retracted out of engagement with the links of the conveyor flight 16. With the depending end of the pin 28 out of engagement with the conveyor flight 16, the movement of the load bearing unit 12 is interrupted so that work can be performed on the load or workpiece carried thereon while other or following load bearing units 12 continue to move with the conveyor flight 16 along the defined path. Now referring to FIG. 4, as a following load bearing unit 12 reaches the trigger means 72 located upstream of the stopped load bearing unit 12 positioned at the actuating means 38, the moving load bearing unit 12 contacts the upstanding lever 74. As shown, the frame structure 22 of the moving load bearing unit 12 contacts the upstanding lever 74, however, depending upon the construction of the frame structure 22, a lever trip arm attached to the frame structure 22 could be used. As the moving load bearing unit 12 continues to move with the conveyor flight 16 past the trigger means 72 and toward the stationary load bearing unit 12 at the actuating means 38, it causes the lever 74 to pivot about the pivot pin 78 from the first position (shown in FIG. 3) to the second position (shown in FIG. 4). As the lever 74 pivots to the second position, it pulls the cable 80, thus, causing the ramp control arm 62 to pivot about its pivot pin 64 from the first position (shown in FIG. 3) to the second position (shown in FIG. 4). As the ramp control arm 62 pivots against the biasing force of the biasing means 70 to the second position, the ramp contact pin 66 at the free end of the ramp control arm 62 moves longitudinally of the top plate 56 of the ramp plate in a direction toward the ramp pivot pin 52 to a position below the housing top wall 48. Concurrently, due to the downward force exerted by the coil spring 32 biasing the conveyor engagement pin 28 toward the conveyor flight 16, the pin spring keeper 34 forces the ramp plate 50 to pivot about its pivot pin 52 to a position whereat the ramp surface 54 is below the housing top wall 48. As the ramp plate 50 pivots from the first to the second position, the depending end of the conveyor engagement pin 28 re-engages with the conveyor flight 16 for resumed movement with the conveyor flight 16 before the following load bearing unit 12 makes contact with the load bearing unit 12 positioned at the actuating means 38.

As the load bearing unit 12 at the actuating means 38 resumes movement and moves away from the actuating means 38, the biasing spring 70 returns the ramp control arm 62 to its first position, thus, causing the ramp plate 50 to pivot about its pivot pin 52 to the first position whereat the ramp surface 54 extends upwardly above the housing top wall 48, and also by pulling on the cable 80 moves the trigger lever 74 back to the first position.

Figure 9:
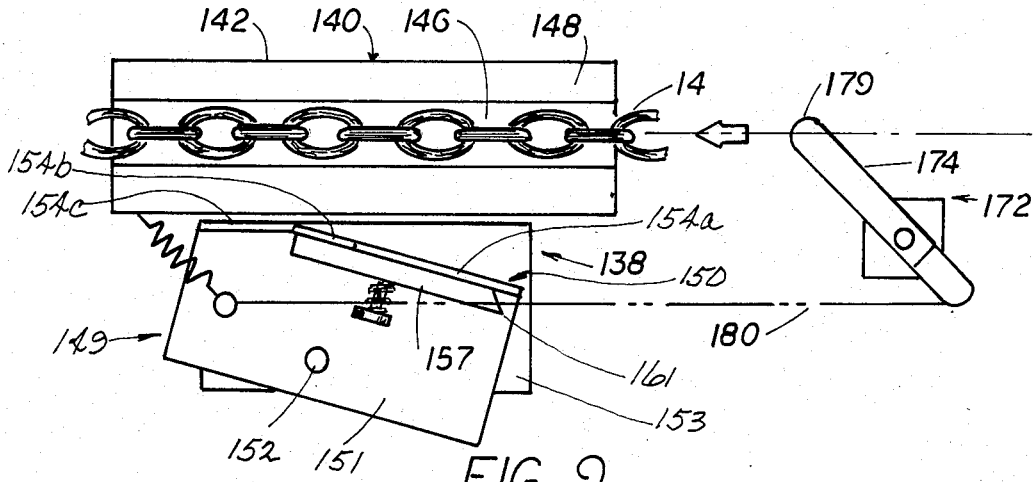
FIG. 9 is a top view of the interruption device of FIG. 7.
Figure 10:
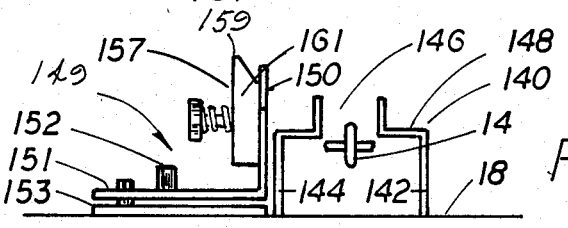
FIG. 10 is an end view of the interruption device as seen in the direction of arrows 10—10 in FIG. 8.

Another advantageous embodiment of a device, generally denoted as the numeral 136, for selectively interrupting the movement of a load bearing unit 12 at a first predetermined location is shown in FIGS. 6–10. In addition to the movable conveyer engagement means 26 attached to the load bearing units 12, as discussed hereinbefore, the interruption device 136 includes actuating means, generally denoted as the numeral 138, for actuating the conveyor engagement means 26 of the load bearing units 12 between the raised conveyor disengagement position and lowered conveyor engagement position (see FIG. 2). As shown, the actuating means 138 includes an elongated open ended housing 140 having parallel spaced apart side walls 142 and 144, and an elongated slot 146 formed therein between the top ends of the side walls 142 and 144 extending from one open housing end to the other open housing end. The housing 140 longitudinally receives the horizontal flight 16 of the conveyor chain 14 through its opposite open ends with the portion of the horizontal flight 16 extending therethrough in parallel alignment with, and below the slot 146. A pin actuating ramp device 149 is mounted next to one wall, for example, side wall 144, of the housing 140. The ramp device 149 includes a generally vertically disposed pin activating ramp plate 150 projecting upwardly from a generally horizontal pivot mounting plate 151. The ramp device 149 is mounted for pivotable movement in a horizontal plane by means of a pivot pin 152 extending through an appropriate aperture in the horizontal pivot mounting plate 151 and into a fixed undercarriage plate 153 fixed to, for example, the facility floor 18 next to the side wall 144 of the housing 140. The ramp plate 150 comprises a top ramp surface 154 which includes three sections: an upstream or advance section **154*a* which is inclined upwardly in the direction of movement of the conveyor flight 16 from an elevation generally inline with the housing top wall 148, a horizontal or dwell section 154*b* which extends downstream from the elevated end of the advance ramp section 154*a*, and a downstream or return section 154*c* which is inclined downwardly from the downstream end of the ramp surface dwell section 154*b* to an elevation at least inline with the top ends of the housing side walls 142 and 144. The ramp surface advance section 154*a* and ramp surface dwell section 154*b* are longitudinally aligned, but the ramp surface return section 154*c* is disposed at an acute angle to the ramp surface dwell section 154*b*. The angle between the dwell section 154*b* and return section 154*c* is approximately equal to the angle through which the ramp device 149 is adapted to pivot. The ramp device 149 is adapted to pivot between a first or conveyor disengagement position (see FIGS. 6 and 8) and a second or conveyor engagement position (see FIGS. 7 and 9). When the ramp device 149 is in the first position, the ramp surface advance section 154*a* and ramp surface dwell section 154*b* are parallel to the portion of the conveyor flight 16 passing through the housing 140, and the ramp surface return section 154*c* is at an acute angle to the conveyor flight 16 extending in a direction away from the conveyor flight 16. When the ramp device 149 is in the second position, the ramp surface dwell section 154*c* is parallel to the portion of the conveyor flight 16 passing through the housing 140, and the ramp surface advance section 154*a* and ramp surface dwell section 154*b* are at an acute angle to the conveyor flight 16. The ramp device 149 is biased about the pivot pin 152 to the first position by means of, for example, a tension coil spring 155 attached at one end to the pivot mounting plate 151 with its other end anchored to, for example, the housing side wall 144. The ramp device 149 further includes a pin displacement shim plate 157 located next to the ramp plate 150 and mounted thereto for movement toward and away from the ramp plate 150. The shim 157 is shown as being planar, having a generally rectangular configuration, and located in side-by-side relationship to the side wall surface of the ramp plate 150. The shim plate 157 is located with its horizontal top edge 159 in general parallel alignment with the ramp surface dwell section 154*b* of the ramp device 149 and extends along the length of the ramp surface advance section 154*a* from the upstream end of the dwell section 154*b* such that the front vertical edge 161 of the shim plate 157 extends upwardly from the location of the lower end of the ramp surface advance section 154*a*. With reference to FIGS. 9 and 10, the top edge 159 of the shim plate 157 is chamfered along its entire length to the side thereof adjacent the ramp plate 150. In addition, as can be best seen in FIGS. 8 and 9, the front edge 161 is chamfered along its entire height to the side thereof adjacent the ramp plate 150. The shim plate 157 is mounted to the side wall surface of ramp plate 150 by means of, for example, a pin 163 attached to the ramp plate 150 and extending generally horizontally therefrom through an appropriate aperture in the shim plate 157. The extending end of the shim mounting pin 163 has an enlarged head 165 with a compression spring 167 coaxially located with the shim mounting pin 163 captured between the pin head 165 and the shim plate 157 so as to bias the shim plate 157** against the ramp plate side surface.

With reference to FIGS. 5 through 10, the movement interruption device 136 further includes trigger means, generally denoted as the numeral 172, for triggering the activating means 138 from the first or conveyor disengagement position to the second or conveyor engagement position in response to the locating of another load bearing unit 12 at a predetermined second location well upstream, relative to the direction of movement of the conveyor flight 16, of the predetermined first location whereat movement of a load bearing unit 12 has been interrupted. As shown, the trigger means 172 includes a pivotably mounted lever 174 located next to the conveyor flight 16. The lever 714 is of an appropriate length such that when it is in a first position corresponding to the first or conveyor disengagement position of the activating means 138, it projects horizontally into the path of a load bearing unit 12 moving with the conveyor flight 16. As shown, lever 174 is pivotably mounted to a journal block 176 by means of a pivot pin 178 extending from the journal block 176 through an appropriate hole in the lever 174 between its ends for pivotal movement in a horizontal plane between a first position and the second position. As shown, one end 179 of the trigger lever 174, when in the first position, extends toward the conveyor flight 16 by a distance sufficient to make contact with the depending movable pin 28 of the load bearing units 12 moving therepast with the conveyor flight 16.

The trigger means 172 is operatively connected to the actuating means 138, by, for example, a cable 180, which is attached at one of its ends to the trigger lever 174 at the opposite end thereof from the lever end 179, projecting toward the path of the conveyor flight 16, and attached at the other of its ends to the pivot mounting plate 151 of the ramp device 149. As shown, the cable end attached to the pivot mounting plate 151 is attached thereto at the same location at which the tension coil spring 155 is attached to the pivot mounting plate 151.

In operation, referring to FIGS. 5, 6, 8 and 10, when a load bearing unit 12 moving with the conveyor flight 16 approaches the actuating means 138 of the movement interruption device 136, which is in the first or conveyor disengagement position, the coil spring keeper 34 of the depending conveyor engagement pin 28 of a load bearing unit 12 contacts the ramp surface advance section **154*a* of the ramp device 154. The inclined ramp advance section 154*a* forces the conveyor engagement pin 28 to more in its collar 30 upwardly against the force of the coil spring 34 as the load bearing unit 12 continues to move with the conveyor flight 16 until the depending end of the conveyor engagement pin 28 is retracted out of engagement with the conveyor flight 16. It can occur, due to, for example, variances in the length of the engagement pin 28 because of wear or manufacturing tolerances, or due to wear of the conveyor chain flight 16, that the depending end of engagement pin 28 will be retracted out of driving engagement with the chain flight 16, while the coil spring keeper 34 is still located along the inclined ramp advance section 154*a*, but will still make a slight or brushing contact with the conveyor flight 16. This condition will cause the engagement pin 28, under the biasing force of the coil spring 32 to chatter as the moving conveyor flight 16 passes beneath the depending end of the engagement pin 28 resulting in noisy operation and accelerated wear on the conveyor chain 14 as well as on the movable conveyor engagement means 26. This condition is alleviated by the function of the pin displacement shim plate 157. The top edge of the pin displacement shim plate 157 under the influence of its compression spring 167, will snap under the spring keeper 34 of the depending pin 28 raising the pin 28 to at least the level of the horizontal dwell section 154*b* of the ramp surface 154 of the ramp plate 150, lifting the depending end of the pin 28 completely out of contact with the conveyor flight 16 moving therebeneath. The chamfered top edge 159 functions as a lead angle to the movement of the shim plate 157 beneath the spring keeper 34. With the depending end of the pin 28 out of engagement with the conveyor flight 16, the movement of the load bearing unit 12 is interrupted so that work can be performed on the load or workpiece carried thereon while following load bearing units 12 continue to move with the conveyor flight 16**.

Figure 7:
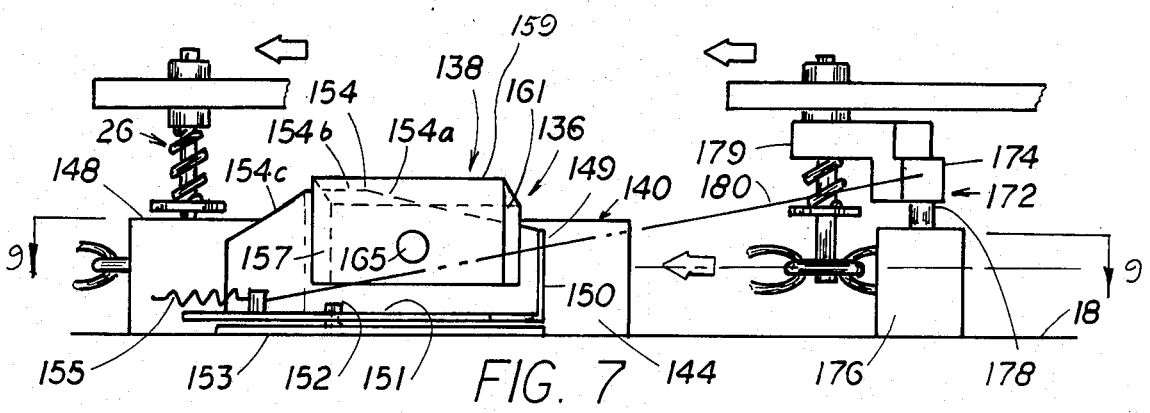
FIG. 7 is an enlarged side view of the interruption device of FIG. 6 in a second position.
Figure 8:
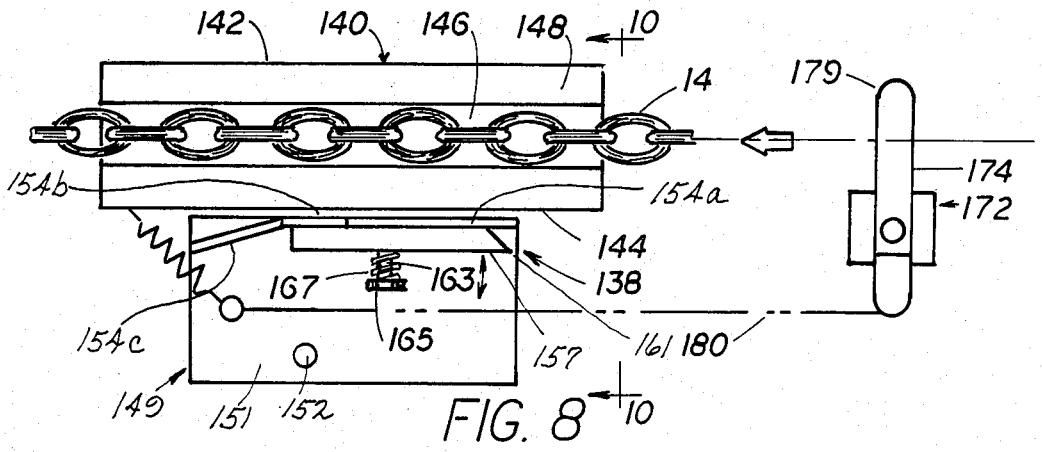
FIG. 8 is a top view of the interruption device of FIG. 6.

Now referring to FIGS. 7 and 9, as a following load bearing unit 12 reaches the trigger means 173 located upstream of the stopped load bearing unit 12 positioned at the actuating means 138, the depending conveyor engagement pin 28 contacts the free end 179 of the horizontal trigger lever 174, and as the moving load bearing unit 12 continues to move with the conveyor flight 16 past the trigger means 174 and toward the stationary load bearing unit 12 at the actuating means 138, it causes the lever 174 to pivot about the pivot pin 178 from the first position to the second position. As the lever 174 pivots to the second position, it pulls the cable 180, thus, causing the ramp device 149 to pivot about the pivot pin 152 thereby causing the downstream ramp return section **154*c* to move beneath the coil spring keeper 34 of the depending conveyor engagement pin 28. The biasing force generated by the coil spring 32 causes the coil spring keeper 34 to move down along the declined ramp return section 154*c*, thus, lowering the conveyor engagement pin 28 downwardly toward the conveyor flight 16 and into engagement with the links of the conveyor flight 16 for resumed movement with the conveyor flight before the following moving load bearing unit 12 makes contact with the load bearing unit positioned at the actuating means 138. As the load bearing unit 12 at the actuating means 138 resumes movement and moves away from the actuating means 138, the tensioning spring 155 causes the ramp device 149 to pivot about the pivot pin 152 back to the first position, and in so doing, pulls the cable 180 moving the trigger lever 174 back to the first position extending toward the conveyor flight 16**.

The foregoing detailed description is given primarily for clearness of understanding and no unnecessary limitations are to be understood therefrom for modifications will become obvious to those skilled in the art and may be made without departing from the spirit of the invention and scope of the appended claims.

What is claimed is:

1. In a conveyor system for moving load bearing units along a path defined by the conveyor flight, a device for interrupting the movement of the load bearing units comprises:

movable conveyor engagement pin means association with each of the load bearing units, the movable engagement pin means being movable toward and into engagement with the conveyor path defining flight wherein the load bearing units are connected to the conveyor flight for movement along the path defined by the conveyor flight, and away from and out of engagement with the conveyor path defining flight;

actuating means comprising a ramp device adapted for pivotable movement about its lower end between a first position forcing the pin means away from and out of engagement with the conveyor path defining flight and a second position providing for engagement of the pin means with the conveyor path defining flight, and a ramp control arm adapted for pivotable movement about its lower end between the first and second positions; and trigger means for triggering the actuating means from the first position to the second position in response to the preselected location of another one of the load bearing units moving along the defined path.

2. The movement interruption device of claim 1, wherein said conveyor engagement pin means is biased in a direction to engage the conveyor path defining flight.

3. The movement interruption device of claim 1, wherein said ramp is biased toward the first position.

4. The movement interruption device of claim 1, wherein the actuating means further comprises means for biasing the ramp control arm in a direction about its pivot to maintain the ramp in the first position.

5. The movement interruption device of claim 1, wherein the trigger means is operatively associated with the actuating means to cause the ramp device to move from the first position to the second position in response to a load bearing unit moving past the trigger means.

6. The movement interruption device of claim 5, wherein the trigger means comprises a lever adapted to contact a load bearing unit passing the trigger means.

7. The movement interruption device of claim 5, wherein the trigger means is operatively associated with the ramp device by a cable interconnecting the trigger means and ramp.

8. In a conveyor system for moving load bearing units along a path defined by the conveyor flight, a device for interrupting the movement of the load bearing units comprises:

moveable conveyor engagement pin means associated with each of the load bearing units, the moveable engagement pin means being moveable toward and into engagement with the conveyor path defining flight wherein the load bearing units are connected to the conveyor flight for movement along the path defined by the conveyor flight, and away from and out of engagement with the conveyor path defining flight;

actuating means comprising a ramp device adapted for pivotable movement in a horizontal plane between a first position forcing the pin means away from and out of engagement with the conveyor defining flight and a second position providing for engagement of the pin means with the conveyor path defining flight; and, trigger means for triggering the actuating means from the first position to the second position in response to the preselected location of another one of the load bearing units moving along the defined path.

9. The movement interruption device of claim 8, wherein the ramp device comprises a generally vertical ramp plate comprising:

an upstream ramp surface advance section for contacting the conveyor engagement means when the ramp device is in the first position to force the pin means away from the conveyor path defining flight; and, a ramp surface dwell section downstream of the ramp surface advance section for contacting the conveyor engagement means as it moves from the ramp surface advance section when the ramp device is in the first position to maintain the pin means displaced away from the conveyor path defining flight.

10. The movement interruption device of claim 9, wherein the vertical ramp plate further comprises a ramp surface return section downstream of the ramp surface dwell section for contacting the conveyor engagement means when the ramp device is in the second position to smoothly allow the pin means to move back toward the conveyor path defining flight.

11. The movement interruption device of claim 10, wherein:

the ramp surface advance section and ramp surface dwell section are in mutual longitudinal alignment; and, the ramp surface return section is at an acute angle to the ramp surface dwell section.

12. The movement interruption device of claim 11, wherein the acute angle between the ramp surface dwell section and ramp surface return section is generally equal to the angle through which the ramp device is adapted to pivot.

13. The movement interruption device of claim 12, wherein:

when the ramp device is in the first position, the ramp surface advance section and ramp surface dwell section are generally parallel to the conveyor path defining flight, and the ramp surface return surface is at an angle to and extending away from the conveyor path defining flight; and, when the ramp device is in the second position, the ramp surface advance section and ramp surface dwell section are at an angle to the conveyor path defining flight, and the ramp surface return flight is generally parallel to the conveyor path defining flight.

14. The movement interruption device of claim 9, wherein the ramp device further comprises a pin means shim plate having a top edge generally aligned with the ramp surface dwell section and extending over the ramp surface advance section, the top edge of the shim plate being adapted to contact the pin means in contact with the ramp surface advance section to force the pin means away from the conveyor path defining flight.

15. The movement interruption device of claim 14, wherein the pin means shim plate is mounted to the ramp device and biased in a direction to contact the pin means.

* * * * *